US006071183A

United States Patent [19]

Havins

[11] Patent Number: 6,071,183

[45] Date of Patent: Jun. 6, 2000

[54] ABRADING MACHINE WITH INDEXING TOOL CARRIER

[76] Inventor: William H. Havins, 717 N. Jackson, Joplin, Mo. 64801

[21] Appl. No.: 09/129,673

[22] Filed: Aug. 5, 1998

Related U.S. Application Data

[60] Provisional application No. 60/054,992, Aug. 6, 1997.

[51] Int. Cl.[7] ..... C08F 265/10

[52] U.S. Cl. ..... 451/296

[58] Field of Search ..... 451/65, 296, 310, 451/311, 414

[56] References Cited

U.S. PATENT DOCUMENTS

| | | | |
|---|---|---|---|
| 1,927,330 | 9/1933 | Williams | 451/300 |
| 2,006,953 | 7/1935 | Klos | 12/1 R |
| 2,518,448 | 8/1950 | Caston | 144/123 |
| 3,024,575 | 3/1962 | Dreiling | 451/1 |
| 4,091,574 | 5/1978 | Horwitz | 451/300 |
| 4,195,449 | 4/1980 | Scarpa et al. | 451/355 |
| 4,204,371 | 5/1980 | Horwitz | 451/303 |
| 4,434,584 | 3/1984 | Rasmussen | 451/297 |
| 4,694,614 | 9/1987 | Shyang | 451/303 |
| 4,881,347 | 11/1989 | Mario et al. | 451/72 |
| 4,964,241 | 10/1990 | Conklin | 451/296 |
| 5,036,626 | 8/1991 | Fuchs | 451/296 |
| 5,388,373 | 2/1995 | Abbate et al. | 451/65 |
| 5,613,900 | 3/1997 | Ramsey | 451/299 |

OTHER PUBLICATIONS

"Woodcraft" Product Catalog, Mar. 1997, pp. 2F, 3–5, 8 and 11.

*Primary Examiner*—Rodney A. Butler
*Attorney, Agent, or Firm*—Jonathan A. Bay

[57] ABSTRACT

An abrading machine has an indexing tool carrier for indexing a plurality of tools such as abrading belts, through plural stations including a single power station and other, unpowered idle stations. Hence the abrading machine provides the user with the option of sharpening a workpiece such as a wood chisel, knife or gouge and the like, on any of the given belts according to the user's selection. The abrading machine provides the economy of a single motor to power any of the given belts which at the time are indexed in the power station position. The other belts which are not indexed in the power station position sit idle. However, these other belts remain available for indexing into the power station position whenever the user wishes to work the workpiece on those belts.

20 Claims, 7 Drawing Sheets

110
114
44
46
94
96
52
88
74
72
68
82
18
20
24
26
58
29
48
22
32
30
54
56
112
98
42
72
98
50
40

40
42
48
54
50
38
112
46
44
56
58
62
110
32
30
36
66
64
114
52
68
74
72

110
110
110
22
24
26
28
30
32
34
36
38
40
42
44
46
48
50
52
54
56
58
60
62
64
66

ABRADING MACHINE WITH INDEXING TOOL CARRIER

CROSS-REFERENCE TO PROVISIONAL APPLICATION(S)

This application claims the benefit of U.S. Provisional Application Ser. No. 60/054,992, filed Aug. 6, 1997.

BACKGROUND AND SUMMARY OF THE INVENTION

1. Field of the Invention

The invention relates to abrading machines and, more particularly, to an abrading machine having an indexing tool carrier for presenting a plurality of tools to the user. In a preferred embodiment according to the invention, the tools comprise endless bands of abrasive material. An illustrative use environment includes sharpening wood chisels. A number of additional features and objects will be apparent in connection with the following discussion of preferred embodiments and examples.

2. Prior Art

Wood chisels are precision instruments, especially carving chisels for fine, exacting work in soft or hard woods. Practiced users of them keep the edges razor sharp. Working with carving chisels is many times easier when the edges are kept razor sharp. Only rough, inaccurate work can be expected from a dull chisel. A dull chisel requires more power to use and may actually be dangerous. Even if stored during non-use to protect their edges, and even if use is limited to wood and none is ever used to pry, the edges will dull after time. At that date proper maintenance of the chisels requires sharpening them.

The known methods for sharpening carving chisels include a wide variety of hand tools as well as grinding wheels. Use of the hand tools is time consuming. A skilled practitioner might take three hours to get a precision edge. The state of the art grinders are typically wet stone grinders. The grinding wheel might be two inches wide (5.1 cm) and ten inches diameter (25.4 cm) and turns in a water trough to spread a water film over it to act as a lubricant for faster beveling while continuously cooling the dull edge to prevent bluing. One manufacturer includes a leather honing wheel alongside the grinding wheel for removing any burr and to hone the edge, i.e., to polish out any small grooves/ridges left in the cutting edge after working it on the grinding wheel.

There are shortcomings with the grinding wheels of the prior art. They produce a hollow-ground edge, i.e., not a flat primary bevel but a concave bevel. And in spite of the water film they easily grind too fast and "blue" the edge, which means that they caused the steel to lose its temper. Abrading machines using grinding wheels often have no more than two different grit wheels, such as coarse and intermediate, making it necessary to use another tool to finish a typical task, eg., to hone the workpiece's work edge. Grinding wheels are prone to uneven wear, require regular maintenance, and are expensive to replace when worn out. What is needed therefore is an improved sharpening apparatus that overcomes the shortcomings of the prior art without sacrificing simplicity and economy.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
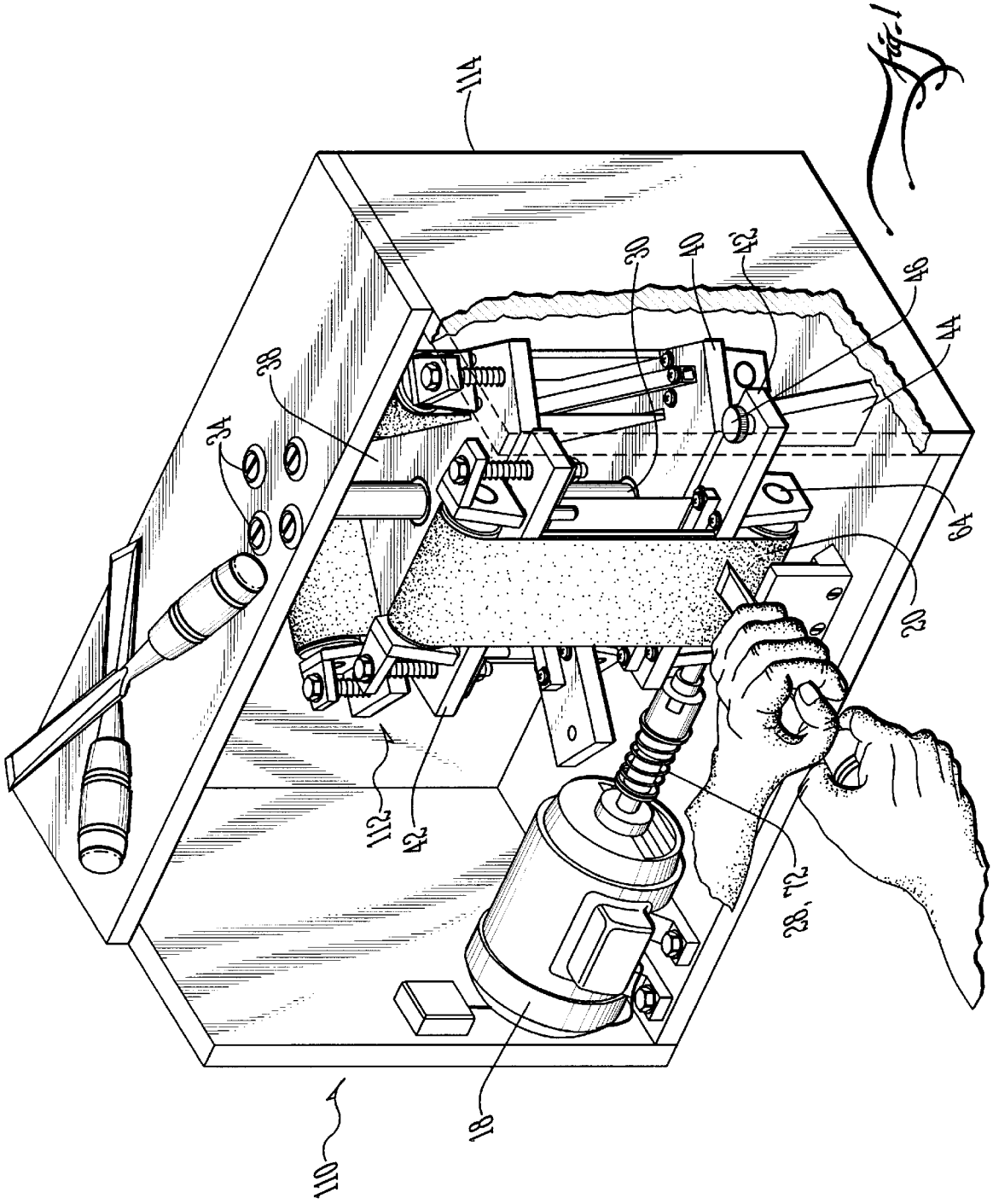
FIG. 1 is a perspective view of an abrading machine with an indexing tool carrier in accordance with the invention, and which is shown in use sharpening a wood carving chisel to illustrate an operative use environment therefor.
Figure 2:
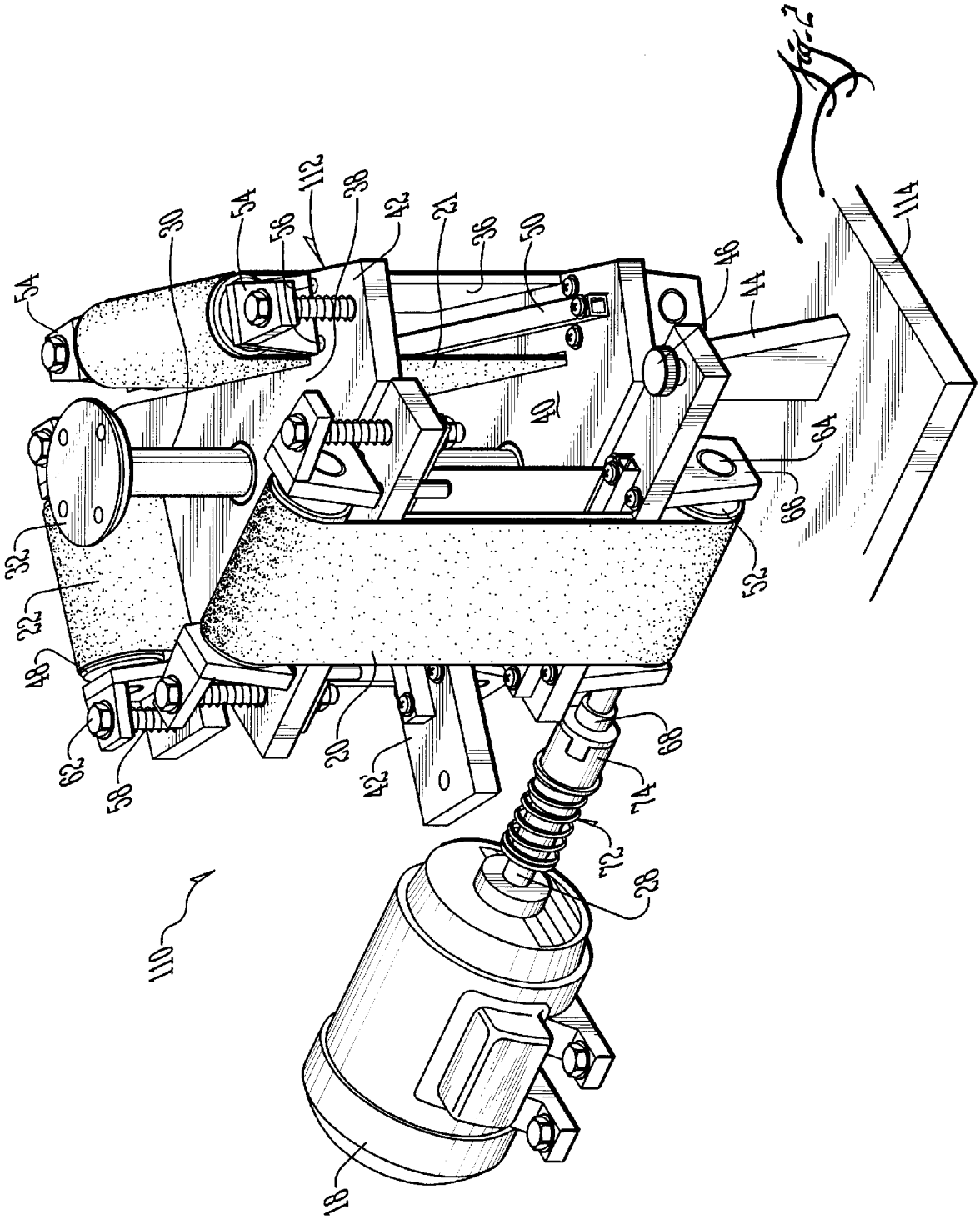
FIG. 2 is an enlarged scale perspective view thereof, except that the top and sides of the cabinet are removed to better show the plural-tool tool carriage according to the invention.
Figures 3, 4:
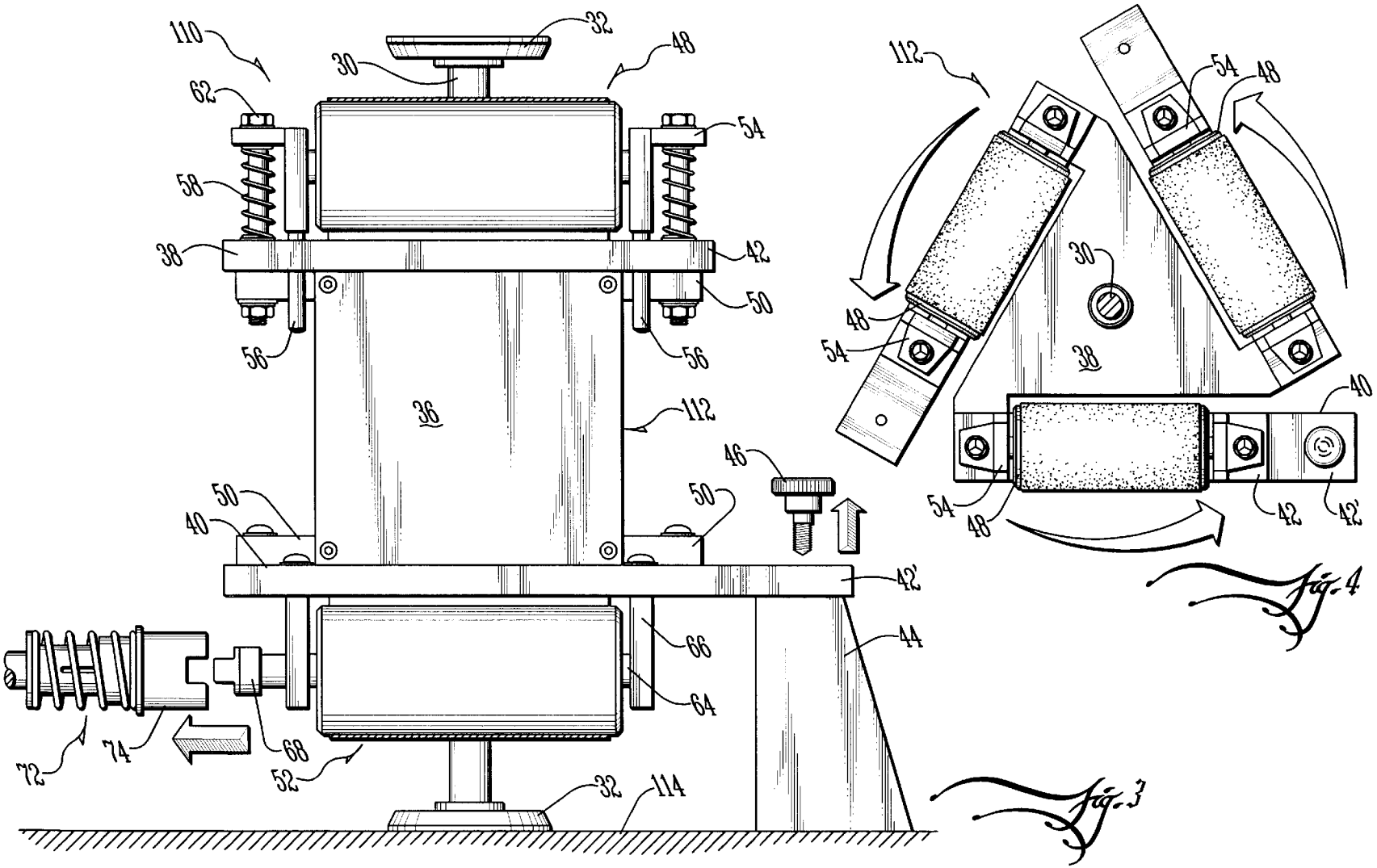
FIG. 3 is a front elevational view of FIG. 2 of the given workstation that is indexed in position for coupling to the drive shaft (i.e., the drive station), except that the belt and the drive motor are removed and that the spring-biased coupler (for quick coupling and decoupling of the drive shaft) is shown decoupled.
FIG. 4 is a top plan view of FIG. 3 showing rotation or indexing of the plural-tool tool carriage.

With general reference to FIGS. 1 through 3, an abrading machine 110 that has an indexing tool carrier 112 in accordance with the invention is shown mounted in a cabinet 114. To illustrate an example operative use environment for the abrading machine 110 according to the invention, it is shown in use by a user who is sharpening the edge of a wood carving chisel. FIGS. 10–13 show an optional clip-on rest fixture 140 which can be an accessory to the abrading machine 110 and mounted in front of the belt 20 for resting or supporting the chisel (or plane iron or whatever else) during sharpening. The rest fixture 140 will be more particularly described below in connection with FIGS. 10–13.

The abrading machine 110 is housed within its own cabinet 114 which preferably is made of three-quarter inch (19 mm) lumber products such as medium density fiberboard or plywood and the like. The cabinet 114 includes at least a bottom, three sides and a top, and among its other purposes the cabinet 114 gives the abrading machine 110 some measure of portability. The abrading machine 110 is powered by means of an electric motor 18 to drive the belts 20–22 as will be described. The cabinet 18 also provides a measure of safety in that it partly shields the wiring as well as acts as a guard around the drive shaft 28 to keep unwanted articles from errantly landing or falling on the drive shaft 28 during use and so on.

Each belt 20–22 shown in the drawings is termed here—in accordance with the terminology adopted for this written description—a "tool." Moreover, a chisel, gouge or knife (or whatever else will be sharpened) is not a "tool" but a "workpiece." Hence, the tool carrier 112 as configured here for depiction in these drawings is carrying three tools 20–22 (i.e., each tool being a belt assembly). The exact number of tools, however, could be varied during the design and construction of an abrading machine 110 in accordance with the invention, and therefore the depiction here of a "three tool" configuration is given for convenience in this written description and is not limiting to the invention for it can be adapted to carry a plurality of tools as desired.

Thus the plural-tool tool carrier 112 in accordance with the invention is rotatably mounted on a vertical carrier shaft or "stanchion" 30. The stanchion 30 extends between upper and lower flanges 32 (see FIG. 3) which are secured to the top and bottom respectively of the cabinet 114 by fasteners (indicated by reference numeral 34 in FIG. 1). The plural-tool tool carrier 112 comprises upper and lower tables 38 and 40 that are mounted at spaced positions on the stanchion 30 as shown. The tables 38 and 40 can be made from sufficiently stiff and strong wooden materials but any suitable material will suffice.

FIG. 4 shows that the upper table 38 (as generally representative of the similar lower table 40) generally has a triangular planform. Each edge of the triangular planform comprises an arm portion 42 that extends between a base and a terminal end. FIGS. 1 and 2 show better that these wooden arms are reinforced or stiffened by one-half inch (13 mm) square steel tubing 50. FIG. 3 shows that spacing between the upper and lower tables 38 and 40 is given by a three panels 36 extending between and fastened to these square tubes 50. In FIG. 4, it also shows that the arms 42' of the lower table 40 are longer than the arms 42 of the upper table 38. With reference back to FIG. 3, the extra extension of the lower arm 42' allows it to lap over an indexing post 44 anchored to the cabinet bottom. A screw knob 46 releasably fastens any given arm 42' of the lower table 40 to the indexing post 44 when that given belt 20 through 22 is indexed to the front of the cabinet 114. When a given belt 20-22 is indexed to the front of the cabinet 114, it can also be referenced as having been indexed to the work-, or drive- or "power-station."

Staying in FIG. 4, each arm 42 or 42' of the upper or lower table provides a mounting surface for an upper or lower roller assembly 48 and 52, respectively. Each upper roller assembly 48 comprises a roller mounted between opposite bearing blocks 54. Each bearing block 54 has an inverted-L shape and a pair of vertical guide pins 56 (the pairs of guide pins 56 for each block 54 are best shown by FIG. 2). The vertical guide pins 56 extend down from the overhead bearing block 54 and can slide up and down in appropriate guide holes for them in the arm 42 (the hole is not in view). The bearing blocks 54 are urged upwardly by compression springs 58. Bolts 62 extending through the centers of the compression springs 58 allow adjustment of the relative compression in the springs 58, and therefore allow adjustment of the relative height of the given bearing block 54 off the arm 42.

Each lower roller assembly 52 comprises a driven roller mounted on a shaft 64 extending between opposite bearing blocks 66 (which are not adjustable). The roller shaft 64 has a tag end 68 (which is the left end as oriented in FIG. 3) which terminates in a spline. Of each tandem of upper and lower rollers 48 and 52, the lower roller 52 is the driven roller of the two, and upper roller 48 is the idler. As shown by FIGS. 1 and 2, power is transmitted to the lower roller 52 by the drive shaft 28 from the motor 18 and vis-a-vis a coupler mechanism 72 for quick coupling and decoupling between itself and the spline end 68 of the roller shaft 64. As FIG. 3 shows, this coupler mechanism 72 has a slot head 74 which mates with the spline end 68 of the roller shaft 64.

As previously stated, this coupler mechanism 72 allows quick coupling and decoupling between itself and the spline end 68 of any given lower roller 52. Whereas there is only one motor 18 to service the three lower rollers 52, any given lower roller 52 can be selected for coupling to the motor 18 via the steps of indexing the tool carrier 112 and then coupling the lower roller 52.

Figure 5:
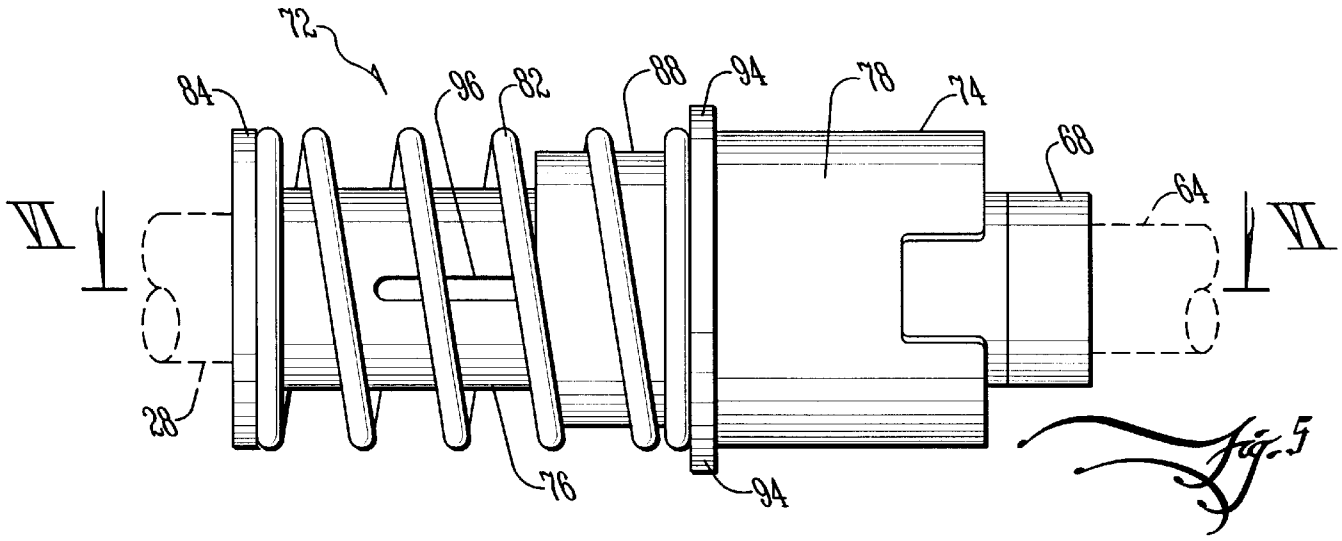
FIG. 5 is an enlarged elevational view of the spring-biased coupler mechanism.
Figure 6:
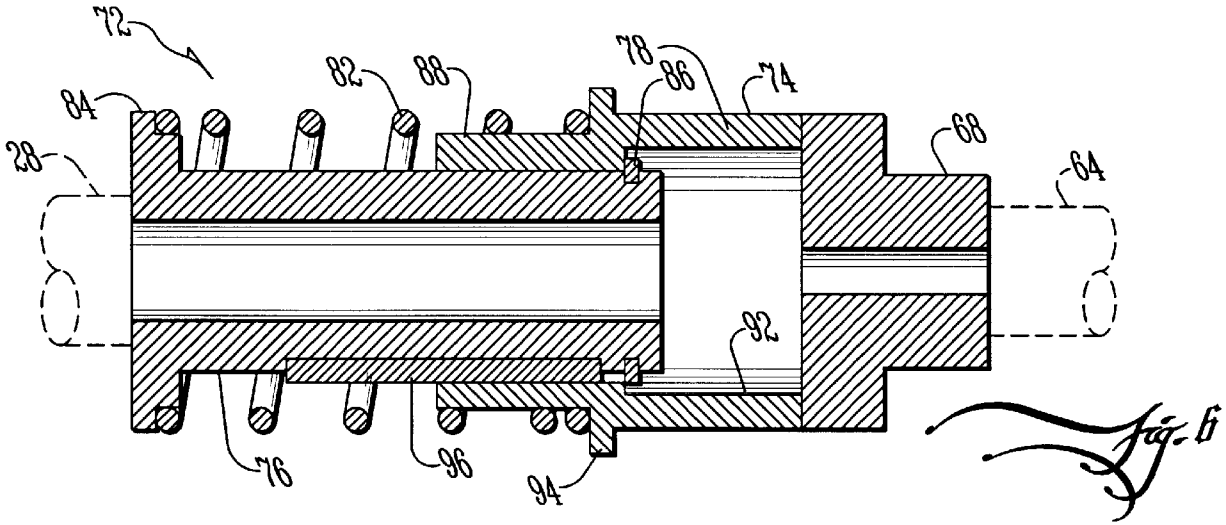
FIG. 6 is a section view taken through line VI—VI in FIG. 5.

FIGS. 5 and 6 show details of the coupler mechanism 72. It comprises a pair of telescoped sleeves 76 and 78 and a compression spring 82 which acts to resist foreshortening of the telescoped sleeves 76 and 78. The inner sleeve 76 has a flange end 84 that provides one stop surface for an end of the compression spring 82. The inner sleeve 76 extends away from the flange end 84 to an opposite end formed with an external peripheral groove for receiving a retaining ring 86 or E-ring or the like. The outer sleeve 78 has a constricted portion 88 for mating the inner sleeve 76 and allowing relative sliding therebetween. The constricted portion 88 enlarges into a clearance space 92 to allow clearance for and extension and retraction therein of the retaining ring 86 on the inner sleeve 76. The outside of the outer sleeve 78 is formed with a flange 94 which forms the stop surface for the other end of the compression spring 82. Relative turning between the inner and outer sleeves 76 and 78 is prevented by a sliding key and keyway arrangement 96.

In use, the inner sleeve 76 is fixed on the motor shaft 28 (indicated in dashed lines in FIG. 5) and the opposite end of the outer sleeve 78 is attached to the slot head 74 of the coupler mechanism 72. A user can foreshorten the coupler mechanism 72 by forcing the outer sleeve 78 against the resiliency of the spring 82 such that the inner sleeve 76 slides further inserted therein, and thereby compress the spring 82 and coupler mechanism 72 at the same time. After the user releases the outer sleeve 78, the coupler mechanism 72 will restore itself to a given state of extension.

FIG. 2 shows the coupler mechanism 72 at rest in a given state of extension. The slot head 74 is engaged with the spline end 68 of the driven roller 52 of a given belt drive or tool 20. Switching ON the motor 18 would result in the turning of the belt 20 at the power station, while the other two belts 21 and 22 sit stationary. In FIG. 2, the belt 20 at the power station is the relatively finest grit of the three belts. In the clockwise direction around the tool carrier, the next belt 22 is the coarsest and the last belt 21 is intermediate.

The belts 20–22 can be three inches (7.6 cm) wide in twenty-four inch (60 cm) bands, and are commonly available from many manufacturers such as the 3M Company as well as other standard OEM's. The grit ranges will be chosen ordinarily from a range between coarse and fine extremes, including an intermediate grit. Example belt products include the products of the 3M Company that are available under brand name and product code TRIZACT™ 307EA. The belt selection has included a grit A65 for the coarsest, and grit A16 for the finest, with a grit in between those two extremes chosen for the intermediate grit. Of course a person having ordinary skill would select appropriate belts for his or her purposes through trial and error as is well known, and therefore the example ranges given here are for convenience in this written description and are not limiting. In fact, it may be preferred if the finest belt were to have properties as fine as about a halt micron grit, as some specialty products of the 3M Company are known to have.

The motor speed is reduced down such that the belt speed is 180 inches per second (460 cm/s). That way, a user can hold the blade by hand and feel it warm up before "bluing" occurs. Given such a warning signal, the user can move the edge off the belt and preserve the temper. It is anticipated that a user will often use all three belts 20–22 to complete the sharpening of one chisel or plane iron. The user would proceed in succession from the coarsest grit and on through to completion with the finest grit. At a time when the user was selectively customizing the choice of belts for the abrading machine 110, the value of the coarsest grit would have been selected in advance for its suitability in rapidly removing controlled amounts of metal from the workpiece's cutting edge, such as beginning the removal of grinding marks left from the manufacturing process, establishing a new "primary" bevel for the cutting edge, or removing deformities from a dull or damaged edge. The intermediate grit would have been selected in advance for its suitability in beginning the polishing process, ie., removing grooves/ridges from the ("primary") bevel and/or cutting edge, and for its suitability for establishing a "secondary" bevel on the cutting edge, if required. Generally, for a woodcarving knife the proper bevel is near 15°, for gouges perhaps it is 220, for both chisels and plane irons about 25°, and so on. The proper bevel is specified by the original equipment manufacturer or alternatively is referenced in standard reference books. Experienced wood-workers often adjust these angle, slightly increasing or decreasing the angle due to various characteristics of the wood they are working and/or to their personal woodworking style. The finest grit would have been selected in advance for its suitability in "honing" the bevel or, that is, polishing out the smallest remaining grooves/ridges and/or irregularities on both sides of the cutting edge. Chisels, planes and knives and the like are require honing for most woodworking tasks.

To proceed orderly through the successively finer belts, a user needs to start with the tool carrier 112 indexed such that the coarsest grit belt 22 is indexed into the power station. FIG. 2 shows however that the finest grit belt 20 is indexed to the power station. Thus the user needs to index the tool carrier 112 one station counterclockwise. With the motor switched OFF, it is shown in FIG. 3 that the user unscrews the knob 46 from the indexing post 44 and pulls back the coupler mechanism 72 to free it from the spline end of 68 the roller shaft 64. FIG. 4 shows that the user turns or indexes the tool carrier 112 counterclockwise one station until the coarsest grit belt 22 is positioned in the power station. The user then re-couples the coupler mechanism 72, tightens the knob 46, and is thus ready to switch the motor 18 ON for work.

Figures 7, 8, 9:
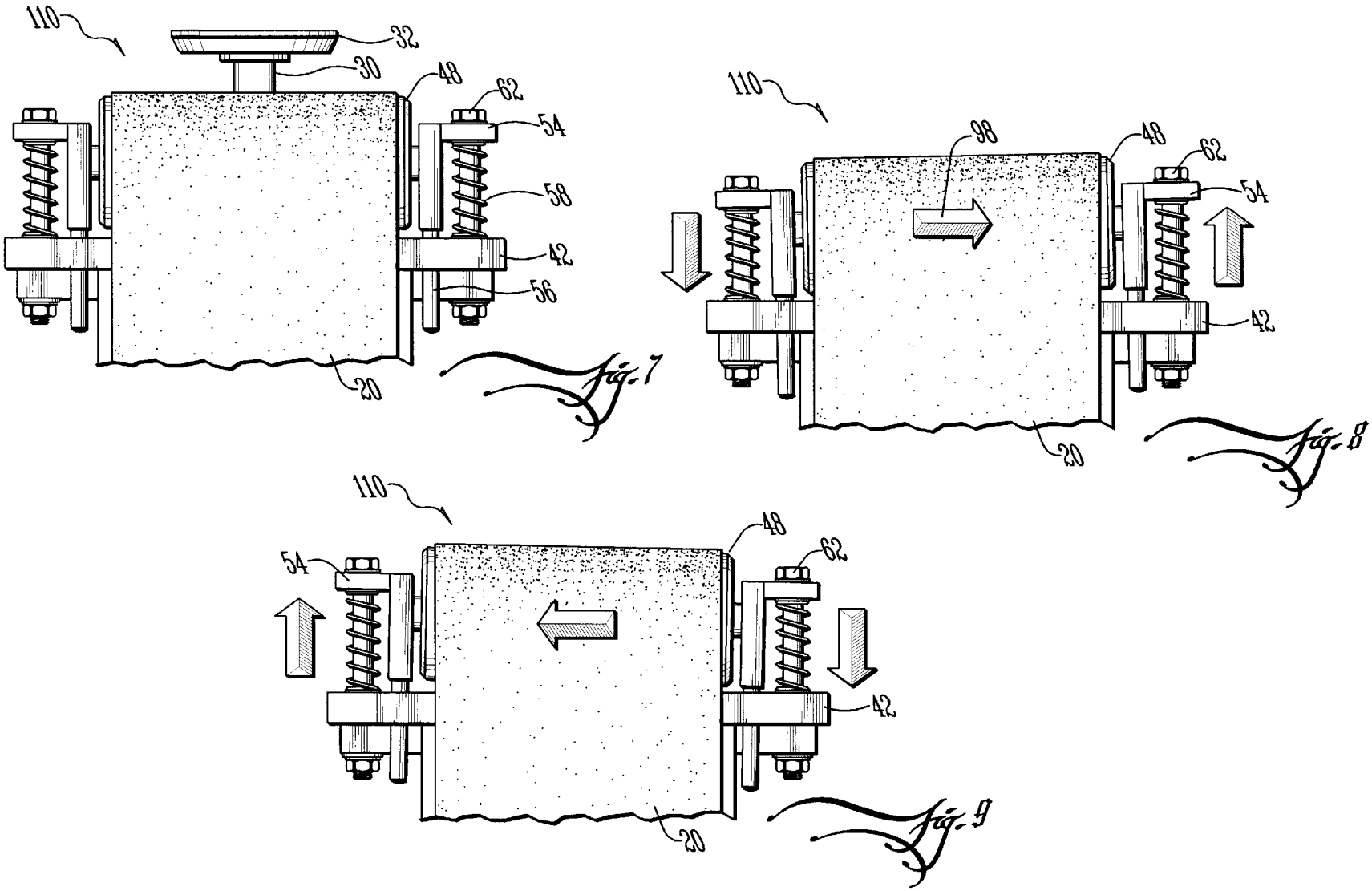
FIG. 7 is a enlarged detail view of the upper roller assembly in FIG. 3.
FIG. 8 is a view comparable to FIG. 7 except showing tracking adjustment for a right-tracking belt.
FIG. 9 is a view comparable to FIGS. 7 and 8 except showing tracking adjustment for a left-tracking belt.

The belts 20–22 can be changed by the following procedure. With reference to FIG. 7, the bolts 62 on either side of the upper roller 48 are tightened to remove tension in the belt 20. With reference to FIG. 1, the user then unscrews the knob 46 from the indexing post 44, pulls back the coupler mechanism 72 to decouple the shafts 28 and 64, and rotates the tool carrier 112 some 45° clockwise. The old belt is removed and a new one put on. The tool carrier 112 is then returned with the belt 20 indexed to the power station, the coupler mechanism 72 is re-coupled and the knob 46 screwed back into the indexing post 44. Tension is applied to the belt 20 by loosening the bolts 62 on either side of the upper roller assembly 48.

After a belt 20 has been changed and tension reapplied, there is a need to insure that the belt 20 tracks sufficiently on the roller 48 and not run off it. Appropriate tracking is achieved by adjusting the axis of the upper roller 48 relative to a horizontal plane. The axis of the upper roller 48 may wind up after adjustment aligned along a true horizontal axis or else slightly inclined off the horizontal, it just depends on how the belt 20 runs on the roller 48. FIG. 8 shows how to adjust tracking to get the belt 20 to shift in the direction of the given indicator arrow 98 (i.e., to the right in the view). To get the belt 20 to track over. the user had to tighten the left bolt 62 and loosen the right bolt 62 until the belt 20 tracked sufficiently without running off the roller 48. Typically, the belt 20 seeks the "high" side of the roller, or that is, it seeks to run "uphill" to where it feels a relatively greater applied tension. FIG. 9 shows the reverse situation in which a user loosened the left bolt 62 and tightened the right bolt 62 until the belt 20 tracked over or shifted left as desired and as indicated.

FIGS. 10–13 show the provision of an inventive rest fixture 140 for the abrading machine 110. The rest fixture 140 provides a "clip-on" and "clip-off" means of attachment and can be quickly swapped about on the abrading machine 110 to mount in front of any one of the three available belt assemblies 20–22. The rest fixture 140 has a declinable shelf 142 to rest a workpiece on while working the workpiece's edge on the belt. Just a single rest fixture 140 is needed since only one belt assembly at a time is operative, that being the belt assembly which is indexed in the power station position. Hence the belt assembly in the power station position is the only belt assembly at the time which provides any opportunity for use of the rest fixture 140. Needless to say, the other belt assemblies which are positioned at either of the unpowered stations are idle.

For this purpose, the rest fixture 140 allows clip-on/clip-off interchangeability among the various belt assemblies 20–22 so that it can be continually swapped among the belt assemblies 20–22 to the one that is indexed at the power station at any given instance. When a user desires to index another of the belt assemblies into the power station position, the user simply un-clips the rest fixture OFF from the one belt assembly at the power station and clips it back ON to the next belt assembly, as more particularly described next.

Figure 11:
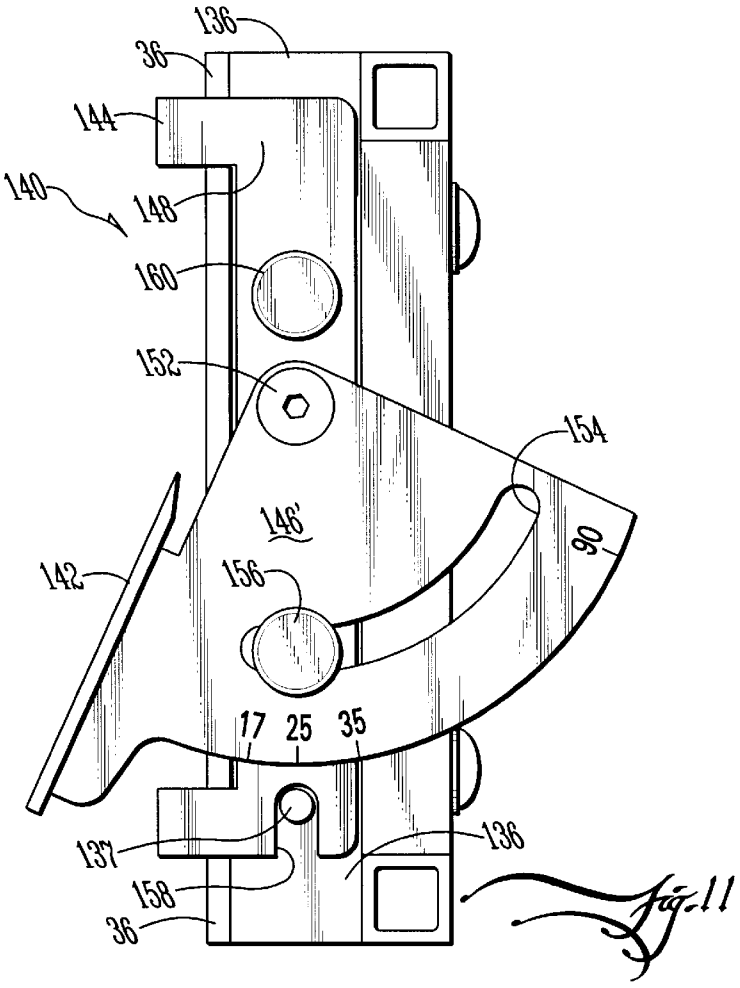
FIG. 11 is an enlarged scale side view of the clip-on rest fixture in accordance with the invention as clipped on in front of one of the three belt assemblies.
Figure 10:
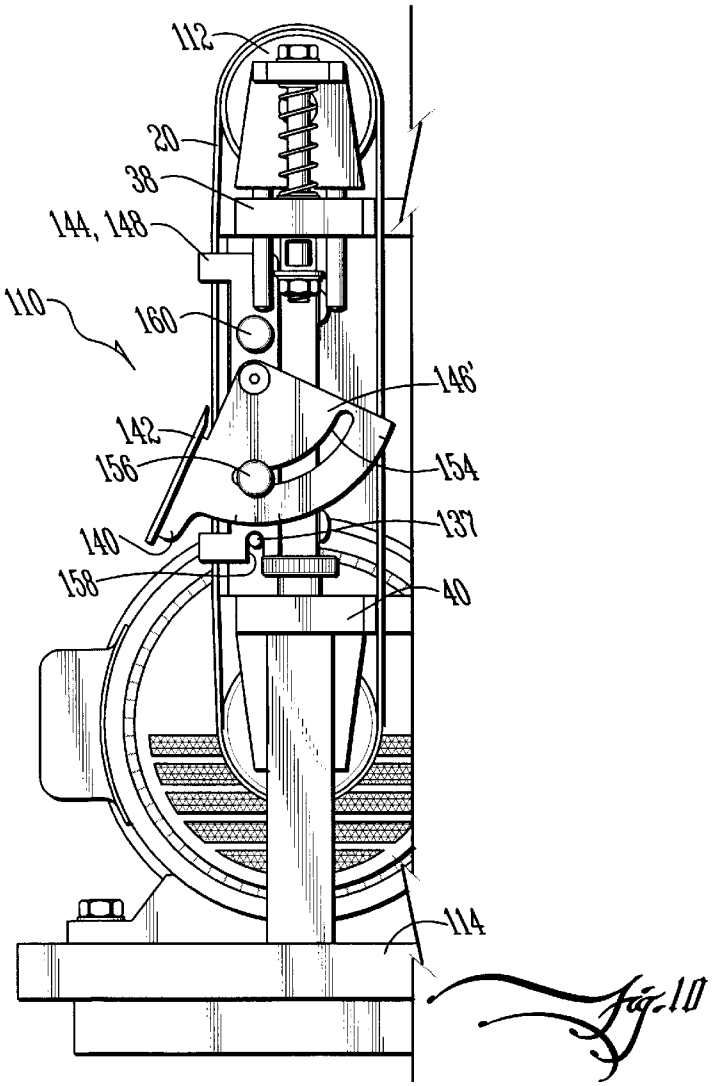
FIG. 10 is a side elevational view of the abrading machine with an indexing tool carrier in accordance with the invention, further showing the provision of an inventive, clip-on rest fixture for supporting a wood carving chisel or the like during sharpening work.
Figure 13:
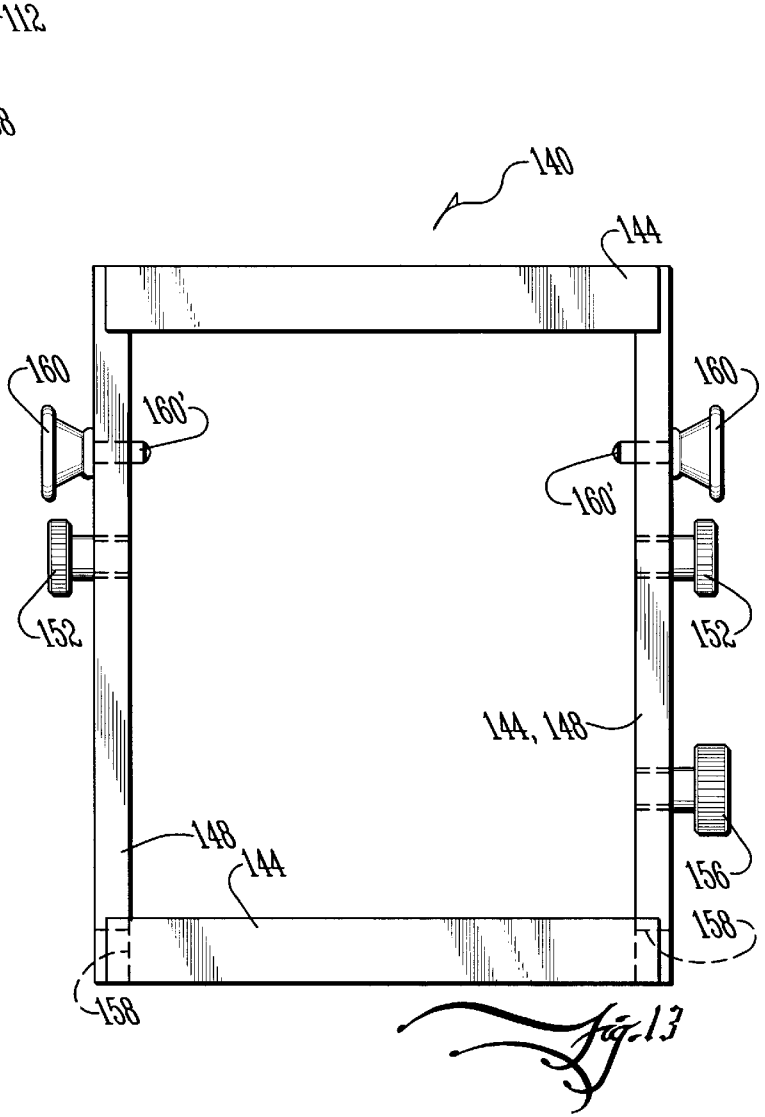
Figure 12:
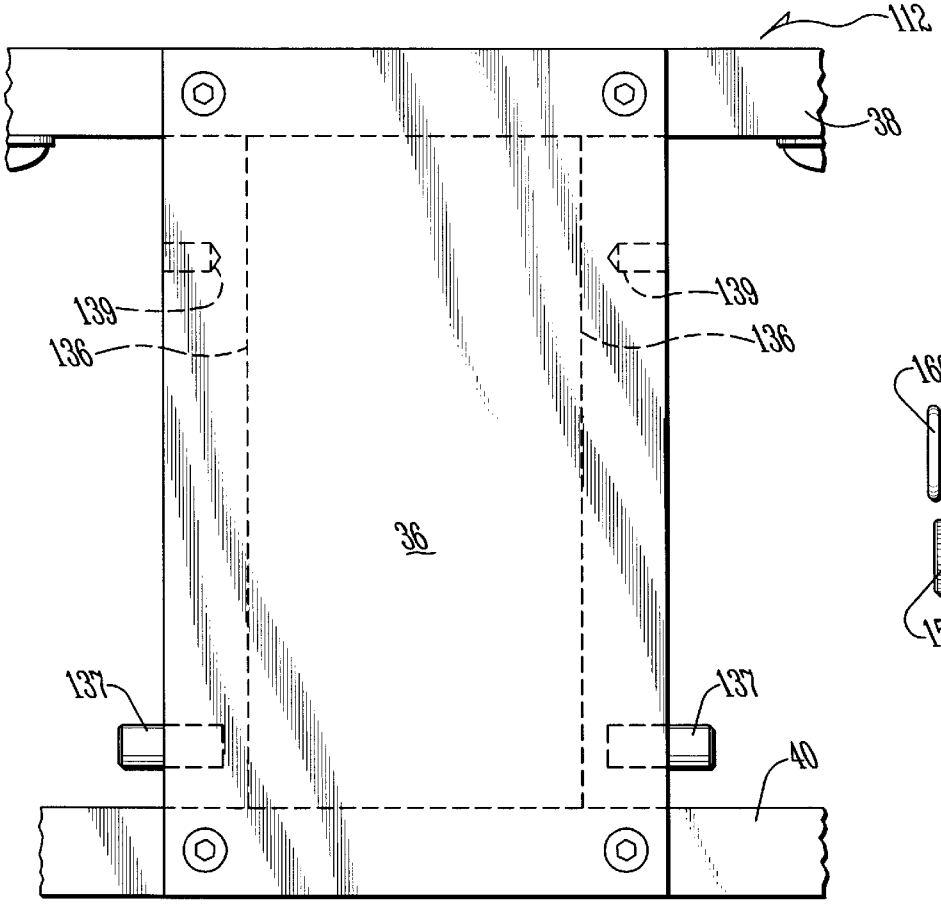
FIG. 12 is a front elevational view of portions of belt assembly (with belt removed from view); and, FIG. 13 is a comparable front elevational view of the clip-on rest fixture in accordance with the invention (with the shelf thereof removed from view).

The rest fixture 140 comprises an open sash 144 (ie., an open frame), the shelf 142, and left and right brackets 146 and 146' (only right-side bracket 146' shown by a side view, and that is in FIGS. 10 and 11) interconnecting the edges of the shelf 142 to the stiles 148 of the sash 144. The bracket 146' on the right-side in FIG. 13 is more particularly a protractor bracket as shown in a side view by either of FIGS. 10 or 11. The brackets 146 are suspended from the stiles 148 of the sash 144 by means of a pair of pivot pins 152. The protractor bracket 146' includes an arcuate slot 154. An adjustment knob 156 inserts through the arcuate slot 154 and is threaded into the right-side stile 148 in the sash 144 (eg., the "right" if given the vantage point of view FIG. 13). Loosening and tightening the adjustment knob 156 allows changing the angle of declination of the shelf 142. As shown in the drawings, the arcuate slot 154 is sized to allow varying the declination of the shelf 142 to between extremes of about 17° and 90°.

The rest fixture 140 removably attaches or "clips on" to the frame of any one of the three available belt assemblies 20–22 in the following manner. By way of background, it will be recalled that each of the belt assemblies 20–22 includes the panel 36 which extends between the upper and lower tables 38 and 40 (these are shown and indicated in FIG. 12). These panels 36 are reinforced by left and right brace members 136 which extend along the left and right edges of the panel 36. The left and right brace members 136 are provided with a pair of opposite left and right hinge-pins 137 as well as a pair of opposite left and right plunger-sockets 139. The sash 144 of the rest fixture 140 clips on to these hinge-pins 137 and plunger-sockets 139 as described next.

The bottom corners of the sash 144 have open eyes 158 (see, eg., FIG. 11). These open eyes 158 of the sash 144 are sized and arranged to latch onto the hinge pins 137 of the brace members 136. Above the open eyes 158—and in fact above the pivot pins 152 from which the brackets 146 are suspended—the stiles 148 of the sash 144 are provided with retractable plungers 160. The plungers 160 have locking pins 160' that are shaped and arranged naturally enough to insert into the sockets 139 for them in the belt assembly brace members 136.

In use, a user clips the rest fixture 140 ON to a given belt assembly as follows. The user picks up and holds the rest fixture 140 such that he or she addresses the given belt assembly with the bottom of the rest fixture 140 sloped away from the user at about 45° degree angle. Then the user latches the open eyes 158 of the sash 144 onto the hinge pins 137 on the belt assembly brace members 136. Next the user swings the sash 144 into registry with the belt assembly brace members 136, retracting the plungers 160 to allow clearance for the sash stiles 148 to flank the belt assembly brace members 136, and then releasing the plungers 160 so that their locking pins 160' can dive into the sockets 139 for them and thus hold the sash 144 firmly to the belt assembly brace members 136.

Following all that, the user is ready to loosen the angle adjustment knob 156 (if desired) and set the protractor bracket 146' to the desired angle. In practice, the range of allowable angles permits a user to abrade a given workpiece from an acute extreme for the angle-of-attack corresponding to as low as about 17° (eg., as for sharpening a straight-bladed knife), to a head-on extreme for the angle-of-attack corresponding to about 90° (eg., as for rough work like removing nicks or other defects from the edge of a chisel or carving gouge). Once the angle has been decided on and set, the user now just needs to quickly tighten the adjustment knob 156 and switch the motor ON for use. In use, the workpiece is rested on the shelf 142 and held against the moving abrasive belt until the desired amount of material has been removed from the worked edge of the workpiece (a workpiece held against a belt is not specifically shown in connection with the rest fixture, but see eg., FIG. 2 for the abrading of a workpiece without the workpiece rest).

When the user desires to change-out the rest fixture 140 and move it over to another of the belt assemblies, he or she might do the following. After the motor is switched OFF and the belt is allowed to come to a stop, the plungers 160 are pulled out and the rest fixture 140's sash 144 is tipped toward the user by virtue of it rotating on the hinge pins 137. The sash 144 is lifted out to clear the hinge pins 137 from the sash 144's open eyes 158. Hence the user is holding the rest fixture 140 free and clear of the abrading machine 110. If the user wants to maintain the same angle-of-attack or "bevel" on the next belt. the angle adjustment knob 156 is left untouched and thus the shelf 142's declination remains unchanged.

The user then sets the rest fixture 140 aside and indexes the tool carrier 112 until the 20 preferred belt assembly comes into the "power station" position. The motor coupling is reestablished. And then the rest fixture 140 is re-attached to this belt assembly, by the steps as described previously, all while leaving the angle of the shelf 142 unchanged. By leaving the angle adjustment unchanged, the angle-of-attack for, or "bevel" of the workpiece will be exactly the same as with the previous belt when it was indexed into the power station position. When ready, the user switches the motor ON and can begin again work on the workpiece with this next belt. Given the foregoing, this provides for more consistency and precision in the abrading of the workpiece edge among the various belts.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. Abrading apparatus providing diverse belts utilized for giving edges to woodworking handtools by a worker manually manipulating a given woodworking handtool against the belts, said apparatus comprising:

a stationary base;

a plurality of belts and a corresponding roller assembly for each belt;

a plural-belt belt carrier on which is mounted the plurality of belts by each belt's corresponding roller assembly;

indexing means anchored to the base for movably mounting the plural-belt belt carrier and for indexing the plural-belt belt carrier through plural index positions such that the belts, one belt at a time, index through a single power station whereby the other belts other than a given one of the belts in the power station at the time, rest idle in other, unpowered idle positions;

a source of drive power for driving the given belt which at the time is indexed in the power station; and, connection/disconnection means for connecting and disconnecting the source of drive power to and from the given belt which at the time is indexed in the power station to allow the indexing out of the given belt and the indexing in of another of the belts by changing the index position of the plural-belt belt carrier relative to the stationary base, which thereby avoids the needless waste of powering the other belts not at the power station at the time because said apparatus provides the worker with utilization of only one belt at a time in any case.

2. The abrading apparatus of claim 1 wherein the plural-belt belt carrier comprises an upper and lower turntable pair for relative turning or that is, relative angular changes in position, the upper and lower turntable pair connected together and supporting the plurality of belts angularly distributed among one another.

3. The abrading apparatus of claim 1 wherein indexing means comprises a locking means for establishing the position of and locking it there the given belt indexed in the power station position.

4. The abrading apparatus of claim 1 wherein each roller assembly comprises a frame mounted to the plural-belt belt carrier for supporting spaced upper and lower belt rollers, one of which is a driven roller and the other of which is an idler.

5. The abrading apparatus of claim 1 wherein the connection/disconnection means comprises a splined plug-and-socket arrangement of a shaft coupler.

6. The abrading apparatus of claim 1 wherein the source of drive power comprises a single motor and a drive shaft extending therefrom and terminating in the connection/disconnection means.

7. The abrading apparatus of claim 2 wherein the indexing means includes an upright stanchion on which is mounted the interconnected upper and lower turntables of the plural-belt belt carrier.

8. The abrading apparatus of claim 4 further comprising a clip-on rest fixture for clipping onto the frame of the roller assembly of the given belt which at the time is indexed in the power station position, said rest fixture including clip-on means for clipping the rest fixture on and off the frame of the roller assembly of the given belt to allow substitution or that is, swapping among the plural belts, which thereby avoids the needless waste of providing additional rest fixtures for the other belts not at the power station at the time because said apparatus provides the worker with utilization of only one belt at a time in any case.

9. The abrading apparatus of claim 8 wherein the rest fixture includes an adjustable shelf and adjustment means for adjusting the relative angle of the shelf relative to the plane of the given belt which at the time is indexed in the power station position.

10. Abrading apparatus providing diverse belts utilized for giving edges to woodworking handtools by a worker manually manipulating a given woodworking handtool against the belts, said apparatus comprising:

an upright stanchion;

a plurality of belts and a corresponding roller assembly for each belt;

a plural-belt belt carrier rotatably mounted on the stanchion and on which is mounted the plurality of belts by each belt's corresponding roller assembly;

indexing means, fixed stationary relative to the stanchion, for indexing the plural-belt belt carrier through plural index positions and for establishing the index position of the belts among plural index positions including a single power station position and other, unpowered idle stations positions;

a source of drive power for driving the given belt which at the time is indexed in the power station; and, connection/disconnection means for connecting and disconnecting the source of drive power to and from the given belt which at the time is indexed in the power station to allow the indexing out of the given belt and the indexing in of another of the belts by rotatably changing the index position of the plural-belt belt carrier relative to the stationary stanchion, which connection/disconnection means thereby avoids the needless waste of powering the other belts not at the power station at the time because said abrading apparatus only provides the worker with utilization of just one belt at a time in any case.

11. The abrading apparatus of claim 10 wherein the plural-belt belt carrier comprises an upper and lower turntable pair mounted on the stanchion for relative rotation or that is, relative angular changes in position, the upper and lower turntable pair being connected together and supporting the plurality of belts in a non-interfering, angularly-spaced distribution among one another.

12. The abrading apparatus of claim 10 wherein indexing means comprises a locking means for establishing the position of and locking it there the given belt indexed in the power station position.

13. The abrading apparatus of claim 10 wherein each roller assembly comprises a frame mounted to the plural-belt belt carrier for supporting spaced upper and lower belt rollers, one of which is a driven roller and the other of which is an idler.

14. The abrading apparatus of claim 10 wherein the connection/disconnection means comprises a splined plug-and-socket arrangement of a shaft coupler.

15. The abrading apparatus of claim 10 wherein the source of drive power comprises a just single motor and a drive shaft extending therefrom and terminating in the connection/disconnection means, whereby the cooperation between the indexing means and the connection/disconnection means allows the drive demands of the plural belts to be fulfilled by just the single motor, in the mode of having the motor power just one belt at a time, that being the given belt at the power station at the time.

16. The abrading apparatus of claim 13 further comprising a clip-on rest fixture for clipping onto the frame of the roller assembly of the given belt which at the time is indexed in the power station position, said rest fixture including clip-on means for clipping the rest fixture on and off the frame of the roller assembly of the given belt to allow substitution or that is, swapping among the plural belts, which thereby avoids the needless waste of providing additional rest fixtures for the other belts not at the power station at the time because said apparatus provides the worker with utilization of only one belt at a time in any case.

17. The abrading apparatus of claim 16 wherein the rest fixture includes an adjustable shelf and adjustment means for adjusting the relative angle of the shelf relative to the plane of the given belt which at the time is indexed in the power station position.

18. The abrading apparatus of claim 17 wherein the adjustment means includes protractor indicia for giving a visual indication of the relative angle between the shelf and the plane of the given belt which at the time is indexed in the power station position.

19. Abrading apparatus providing diverse belts utilized for giving edges to woodworking handtools by a worker manually manipulating a given woodworking handtool against the belts, said apparatus comprising:

a stationary base including a upright stanchion and a source of drive power;

a plurality of belts and a corresponding roller assembly for each belt;

a plural-belt belt carrier rotatably mounted on the stanchion and on which is mounted the plurality of belts by each belt's corresponding roller assembly, the rotatable mounting allowing the plural-belt belt carrier to be indexed through plural index positions such that the belts, one belt at a time, index through a single power station whereby the other belts other than a given one of the belts in the power station at the time, rest idle in other, unpowered idle positions; and, coupling means for coupling the source of drive power to the given belt which at the time is indexed in the power station for thereby enabling drive of the given belt which at the time is indexed in the power station position and to allow the indexing out of the given belt and the indexing in of another of the belts by rotatably changing the index position of the plural-belt belt carrier on the stanchion relative to the stationary base, which coupling means thereby avoids the needless waste of powering the other belts not at the power station at the time because said abrading apparatus only provides the worker with utilization of just one belt at a time in any case.

20. The abrading apparatus of claim 19 further comprising indexing means, fixed stationary relative to the stanchion, for establishing the index position of the belts among plural stations including the single power station position and the other, unpowered idle stations positions.

* * * * *